US008181496B2

(12) United States Patent
McDaid

(10) Patent No.: US 8,181,496 B2
(45) Date of Patent: May 22, 2012

(54) U-LOCK CROSS BRACE

(75) Inventor: Cornelius McDaid, Randolph, MA (US)

(73) Assignee: Ingersoll Rand Company, Montvale, NJ (US)

( * ) Notice: Subject to any disclaimer, the term of this patent is extended or adjusted under 35 U.S.C. 154(b) by 0 days.

(21) Appl. No.: 12/714,925

(22) Filed: Mar. 1, 2010

(65) Prior Publication Data

US 2010/0218572 A1 Sep. 2, 2010

Related U.S. Application Data

(60) Provisional application No. 61/156,215, filed on Feb. 27, 2009.

(51) Int. Cl.
*E05B 71/00* (2006.01)

(52) U.S. Cl. ..... 70/39; 70/51; 70/53; 70/55; 70/227; 70/233

(58) Field of Classification Search ..... 70/51, 53–56, 70/227, 233, 50, 52, 416–418, DIG. 43, DIG. 56, 70/39, 225, 226, 228, 234–236, 259, 260
See application file for complete search history.

(56) References Cited

U.S. PATENT DOCUMENTS

| | | | | | |
|---|---|---|---|---|---|
| 278,053 | A | * | 5/1883 | Shipherd | 81/63 |
| 899,268 | A | * | 9/1908 | Soley | 70/53 |
| 2,541,638 | A | * | 2/1951 | Clevett | 70/56 |
| 2,751,802 | A | * | 6/1956 | Reuillard | 81/124.3 |
| 2,769,360 | A | * | 11/1956 | Cottrell et al. | 81/124.3 |
| 2,827,974 | A | * | 3/1958 | Frank | 180/439 |
| 2,903,909 | A | * | 9/1959 | Engel | 74/581 |
| 3,039,786 | A | * | 6/1962 | Punches | 280/93.508 |
| 3,257,133 | A | * | 6/1966 | Wight | 403/40 |
| 3,428,345 | A | * | 2/1969 | Ryszewski | 403/165 |
| 3,467,421 | A | * | 9/1969 | Bentley | 403/203 |
| 3,783,657 | A | * | 1/1974 | Foote | 70/52 |
| 3,805,564 | A | * | 4/1974 | Velardo | 70/18 |
| 3,887,211 | A | * | 6/1975 | Mazur | 280/86.758 |
| 4,026,578 | A | * | 5/1977 | Mattson | 280/86.754 |
| 4,085,600 | A | * | 4/1978 | Bindari | 70/39 |
| 4,426,861 | A | * | 1/1984 | Chillis | 70/39 |
| 4,748,875 | A | * | 6/1988 | Lang | 81/63 |
| 4,781,043 | A | * | 11/1988 | Loeffler | 70/54 |
| 5,119,701 | A | * | 6/1992 | Wei | 81/63 |
| 5,275,030 | A | * | 1/1994 | Cole | 70/209 |
| 5,448,932 | A | * | 9/1995 | Zurbuchen et al. | 81/124.4 |
| 5,467,620 | A | | 11/1995 | Byrd, Jr. | |
| 5,636,857 | A | * | 6/1997 | Tandy et al. | 280/124.165 |

(Continued)

FOREIGN PATENT DOCUMENTS

DE 3313996 A1 * 10/1984

*Primary Examiner* — Lloyd Gall
(74) *Attorney, Agent, or Firm* — RatnerPrestia

(57) ABSTRACT

A cross brace for securing on a U-lock having a U-shaped shackle with the cross brace comprising first and second engaging members and a connecting member therebetween. The first engaging member defines a first through bore having a first opening and a first central axis. The second engaging member defines a second through bore having second opening and a second central axis. The connecting member extends between and connects the first and second members relative to one another such that an opening plane extending between the first and second openings and intersecting the first and second central axes is at an acute angle relative to the first and second central axes.

14 Claims, 8 Drawing Sheets

U.S. PATENT DOCUMENTS 5,651,561 A * 7/1997 Tandy et al. ..... 280/86.753
6,341,543 B1 * 1/2002 Hsieh ..... 81/63.2
6,701,757 B1 * 3/2004 Vito ..... 70/51
6,928,903 B1 * 8/2005 Liao ..... 81/58.3
7,093,520 B2 * 8/2006 Tuanmu ..... 81/63.1
7,137,319 B2 * 11/2006 Hough ..... 81/60
D552,441 S * 10/2007 Azazian ..... D8/28
2003/0221520 A1 * 12/2003 Ha ..... 81/57.36
2004/0035258 A1 * 2/2004 Spector ..... 81/120
2004/0093914 A1 * 5/2004 Vito ..... 70/38 A
2006/0117815 A1 * 6/2006 St. James ..... 70/56

* cited by examiner

U-LOCK CROSS BRACE

CROSS-REFERENCE TO RELATED APPLICATIONS

This application claims priority to U.S. Ser. No. 61/156,215 filed Feb. 27, 2009, the contents of such application being incorporated by reference herein in its entirety.

BACKGROUND OF THE INVENTION

This invention relates to the field of locks. More specifically, this invention relates to the field of U-locks with detachable crossbars which are commonly used for bicycles.

U-locks are commonly used for locking a bicycle to prevent theft of the bicycle. Ordinarily, a rider will lock the bicycle frame and at least one wheel to a post to secure the bicycle. Often, an experienced rider will remove the front wheel of the bicycle in order to lock it as well.

A U-lock principally includes a U-shaped shackle with two substantially straight and parallel arms coupled to one another by a curved bow, and a removable crossbar. In the prior art, the crossbar has been a bar or tube which includes two holes, each spaced about one inch from the opposite ends of the crossbar. A lock mechanism is fitted in the crossbar for securing the crossbar to the U-shaped shackle.

The U-shaped shackle is made of metal bar stock formed into a U-shape with the arms of the bar in the range of four to six inches apart. Typically, U-locks are designed to have two substantially straight parallel arms which are jointly locked within the crossbar, but may alternatively include a bent foot on one of the arms. The U-locks are locked by inserting the arms into the crossbar and activating the locking mechanism.

To lock a bicycle to a post or other object, the ends of the U-shaped shackle are passed around the post and a portion of the frame and/or one tire (or both) of a bicycle, and secured by the crossbar. It is impossible to predict the thickness of the post to which a rider may desire to lock a bicycle. Further, bicycles are available with a variety of sizes of frame tubes, frame tube spacing, tires and wheels. U-locks are also used to lock motorcycles, boats, jet skis and many other objects.

SUMMARY OF THE INVENTION

In one aspect, one or more embodiments of the present invention provides a cross brace for securing on a U-lock having a U-shaped shackle with the cross brace comprising first and second engaging members and a connecting member therebetween. The first engaging member has a first through bore with a first through bore opening extending in a first plane. The first through bore has a first central axis. The second engaging member has a second through bore with a second through bore opening extending in a second plane. The second through bore has a second central axis. The connecting member extends between and connects the first and second members relative to one another such that the first and second planes are spaced from one another and the first and second central axes are spaced from one another.

In one aspect, one or more embodiments of the present invention provides a cross brace for securing on a U-lock having a U-shaped shackle with the cross brace comprising first and second engaging members and a connecting member therebetween. The first engaging member defines a first through bore having a first opening and a first central axis. The second engaging member defines a second through bore having second opening and a second central axis. The connecting member extends between and connects the first and second members relative to one another such that an opening plane extending between the first and second openings and intersecting the first and second central axes is at an acute angle relative to the first and second central axes.

These and other aspects of the invention are illustrated and described in detail by way of the following exemplary.

BRIEF DESCRIPTION OF THE DRAWINGS

FIG. 7 is a front elevation view illustrating the third exemplary U-lock and the cross brace of FIG. 1 as it is positioned relative to a post or the like.

DETAILED DESCRIPTION OF THE INVENTION

Figure 1:
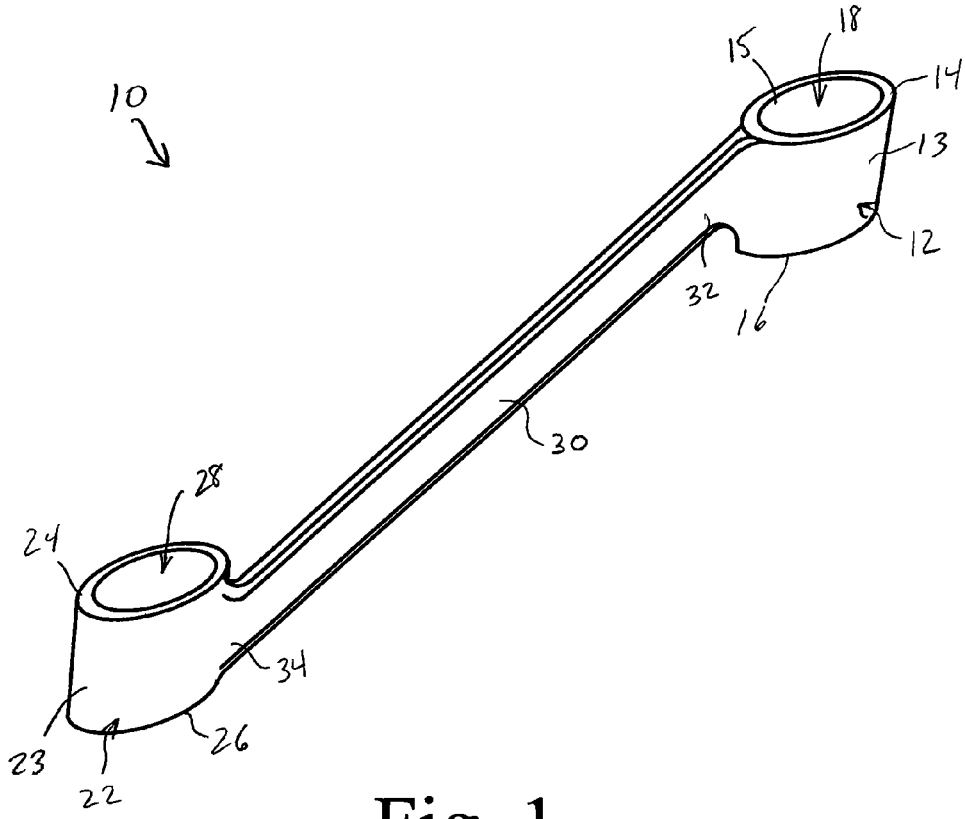
FIG. 1 is an isometric view of a cross brace in accordance with an exemplary embodiment of the present invention.
Figure 2:
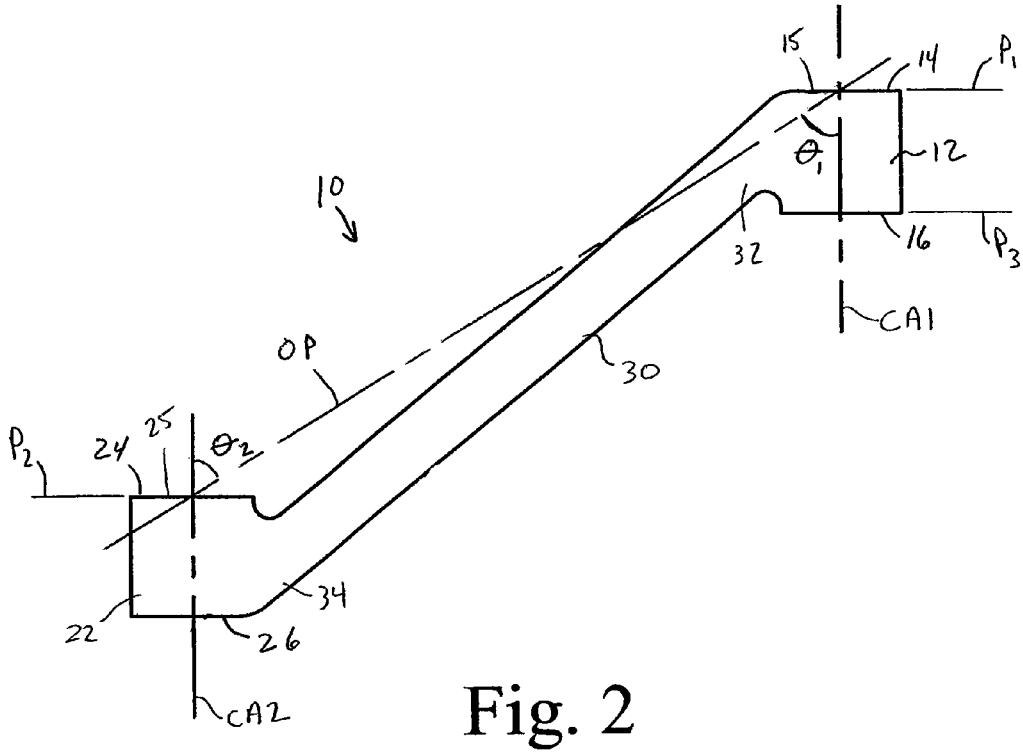
FIG. 2 is a front elevation view of the cross brace of FIG. 1.
Figure 3:
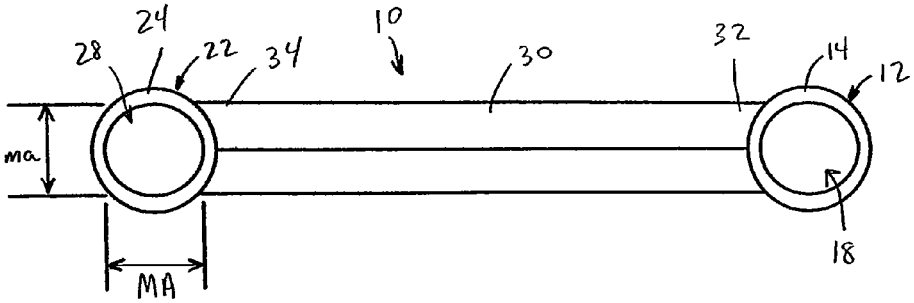
FIG. 3 is a top plan view of the cross brace of FIG. 1.

Referring to FIGS. 1-3, a cross brace 10 that is an exemplary embodiment of the present invention will be described. The cross brace 10 generally comprises a first engagement member 12, a second engagement member 22 and a connecting member 30 extending between and connecting the first and second engagement members 12 and 22. In the present embodiment, the connecting member 30 is rigidly secured at its ends 32 and 34 to the first and the second engagement members 12 and 22, respectively, however other configurations may be utilized.

The first engaging member 12 has a body 13 extending between a top surface 14 and a bottom surface 16. A first through bore 18 extends through the body 13 from an opening 15 along the top surface 14 to an exit 17 (see FIG. 4) along the bottom surface 16. Similarly, the second engaging member 22 has a body 23 extending between a top surface 24 and a bottom surface 26. A second through bore 28 extends through the body 23 from an opening 25 along the top surface 24 to an exit 27 (see FIG. 4) along the bottom surface 26. The terms top surface and bottom surface are used herein for reference only with respect to the orientation of the cross brace 10 as shown in the figures, however, the cross brace 10 is not limited to the illustrated orientation and may be utilized in other orientations. Similarly, the terms opening and exit are also used only with respect to the orientation of the cross brace 10 as shown in the figures, however, the cross brace 10 is not limited to the illustrated orientation and may be utilized in other orientations.

Referring to FIG. 2, each of the through bores 18 and 28 has a respective central axis CA1 and CA2. In the illustrated embodiment, the central axes CA1 and CA2 are parallel to one another, but may have other non-parallel configurations.

The central axes CA1 and CA2 are spaced from one another a distance approximately equally to a distance between the legs 53, 55 of the U-shaped shackle 50, as described below. Referring to FIG. 3, each of the through bores 18, 28 of the illustrated embodiment has an elliptical shape with a major axis MA and a minor axis ma, with the major axis extending in the direction of the connecting member 30. Such a configuration provides more flexibility in the shackle widths which the cross brace 10 may be utilized, as will explained hereinafter. The invention is not limited to elliptical shape through bores 18, 28, but may have other shapes as well, for example, circular, oval, square or any other desired shaped. In each configuration, the dimension of the through bore 18, 28 in the direction of the connecting member 30 is preferably larger than the anticipated diameter of the shackle 52 to provide greater flexibility as described below.

Figure 11:
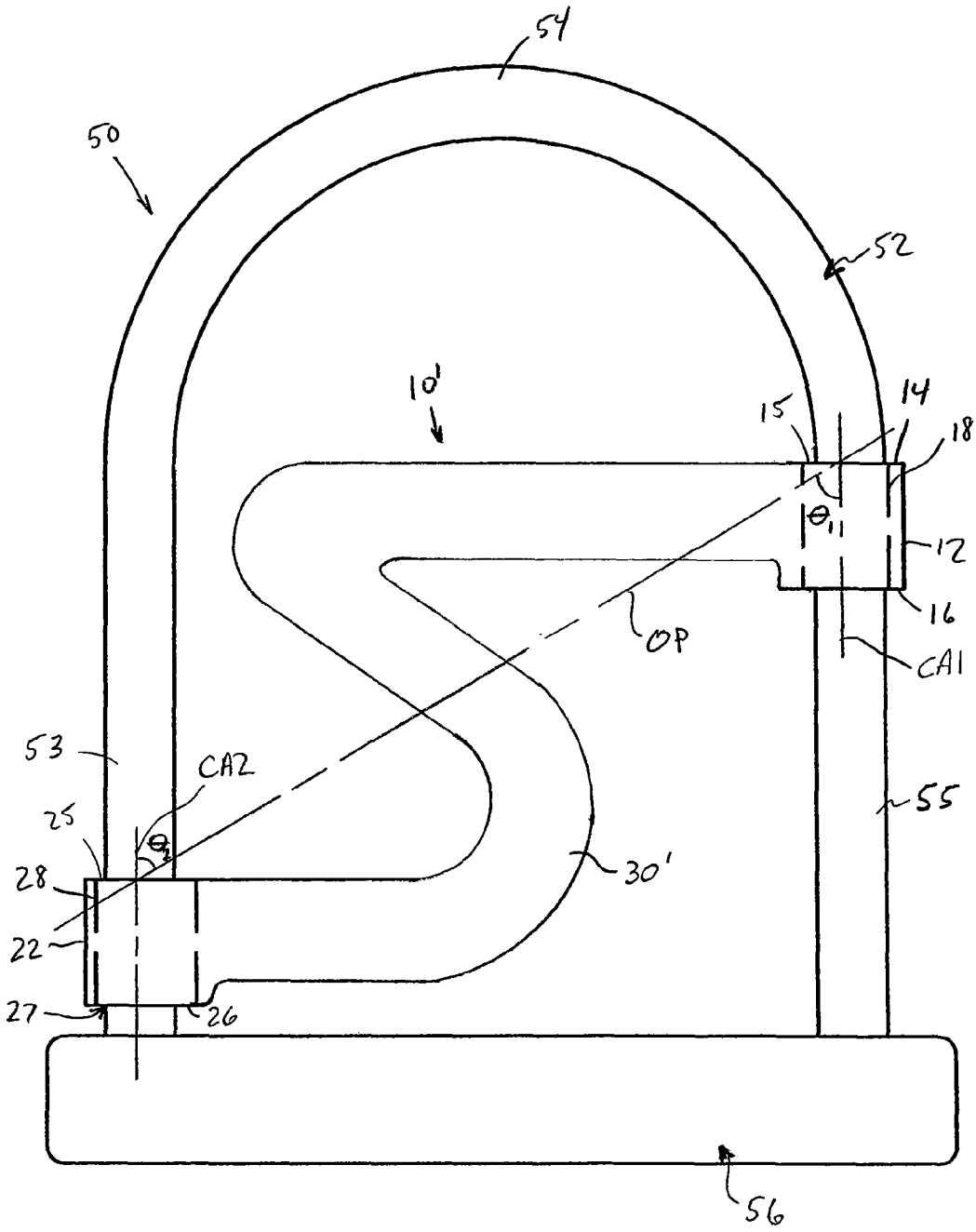
FIG. 11 is a front elevation view illustrating a cross brace that is an alternative embodiment of the invention positioned relative to an exemplary U-lock.

The connecting member 30 of the embodiment illustrated in FIGS. 1-3 has a linear rod configuration. The invention is not limited to such a linear rod configuration, but may have other shapes connecting the two engaging members 12 and 22. For example, but not limited to, the connecting member 30' may have a zig-zag configuration as illustrated in FIG. 11. With such a configuration, the connecting member 30' fills a larger percentage of the area within the shackle 52, thereby further minimizing the likelihood of someone positioning any type of prying member into the U-lock. In all other aspects, the cross brace 10' of FIG. 11 is substantially the same as the other embodiments.

Figure 8:
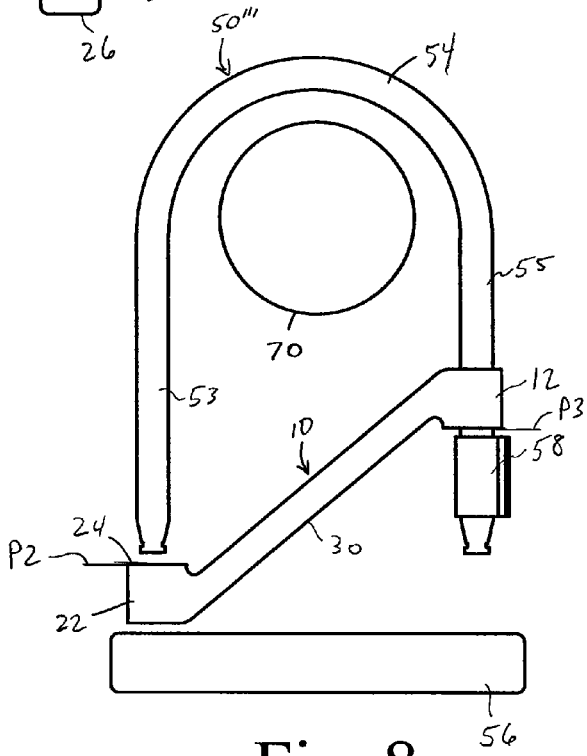
FIG. 8 is a front elevation view similar to FIG. 7 with the cross brace swung to an engagement position.

Referring to FIG. 2, the top surface 14 of the first engaging member 12 extends in a first plane P1 while the top surface 24 of the second engaging member 22 extends in a second plane P2. The first and second planes P1 and P2 are spaced from one another in a direction parallel to the central axes CA1 and CA2. With such a configuration, the shackle 52 will pass through the first through bore 18 with the second engaging member 22 still spaced from the other leg of the shackle 52 as shown in FIG. 8. Furthermore, the bottom surface 16 of the first engaging member 12 extends in a plane P3 which is desirably positioned between the first and second planes P1 and P2 and spaced from plane P2. With this configuration, the first engaging member 12 may be positioned above a bracket connector 58 on the shackle 52 or the like, while the second engaging member 22 remains clear of the shackle 52, as shown again in FIG. 8.

Referring to FIGS. 2 and 11, with the top surfaces 14 and 24 spaced as described above, a plane OP extending between the openings 15 and 25 and intersecting the central axes CA1 and CA2, is at an acute angle $\theta_1$, $\theta_2$, respectively, with respect to each central axes CA1, CA2. The angles $\theta_1$, $\theta_2$ are preferably in the range of approximately 20° and 60° and more preferably in the range of approximately 30° and 45°. The angles $\theta_1$, $\theta_2$ are preferably equal, but do not have to be.

Figure 4:
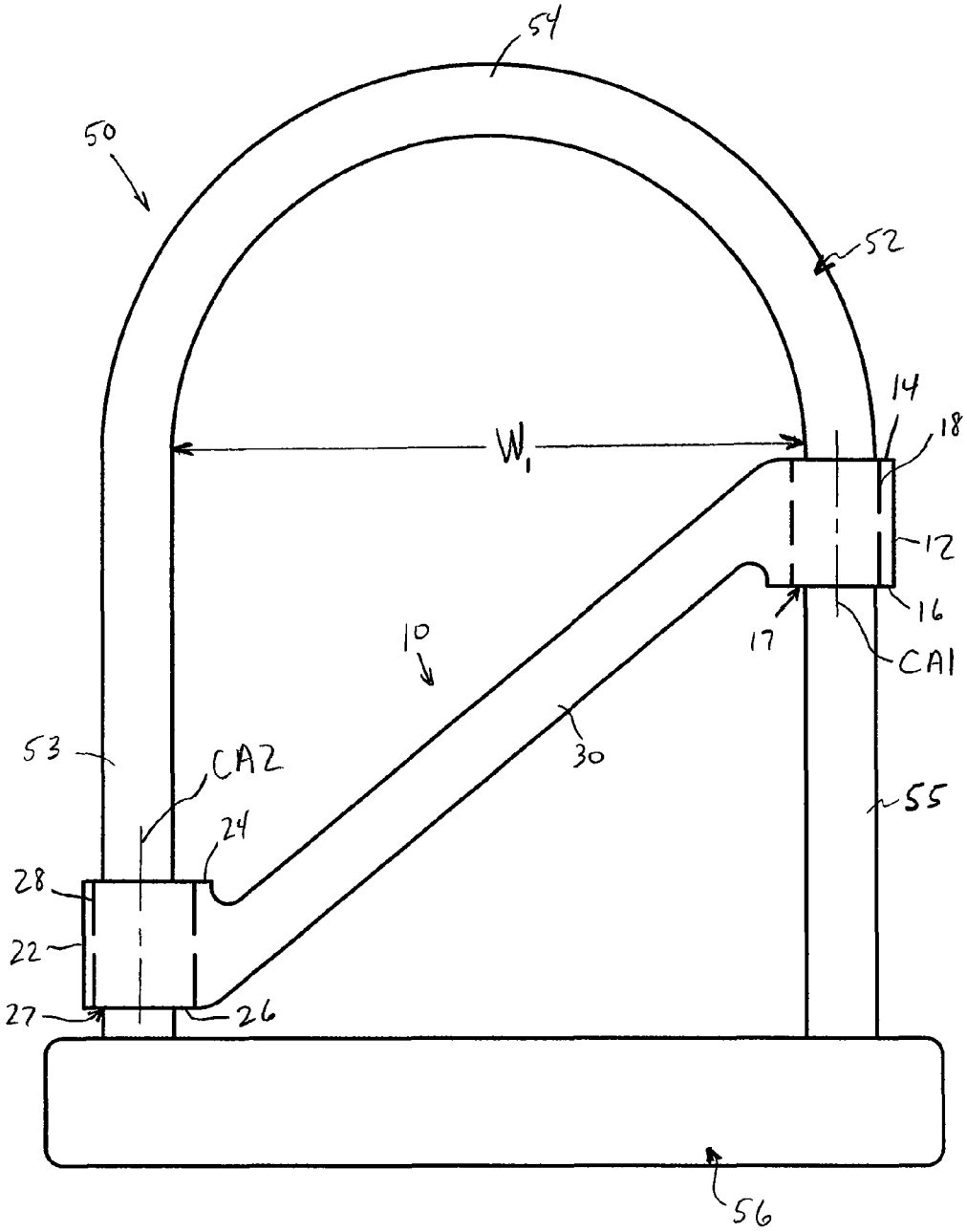
FIG. 4 is a front elevation view of the cross brace of FIG. 1 positioned relative to a first exemplary U-lock.
Figure 5:
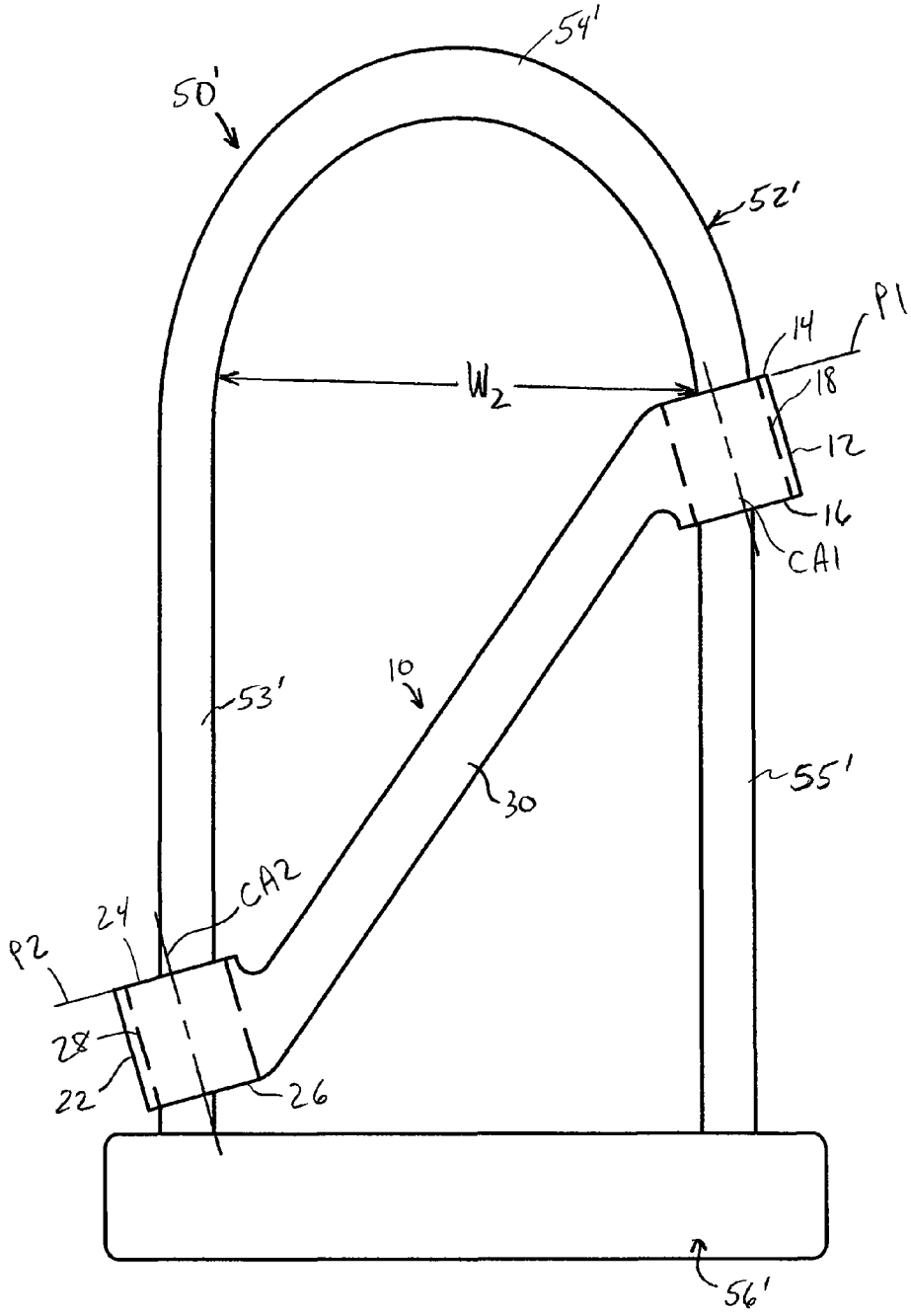
FIG. 5 is a front elevation view of the cross brace of FIG. 1 positioned relative to a second exemplary U-lock.
Figure 6:
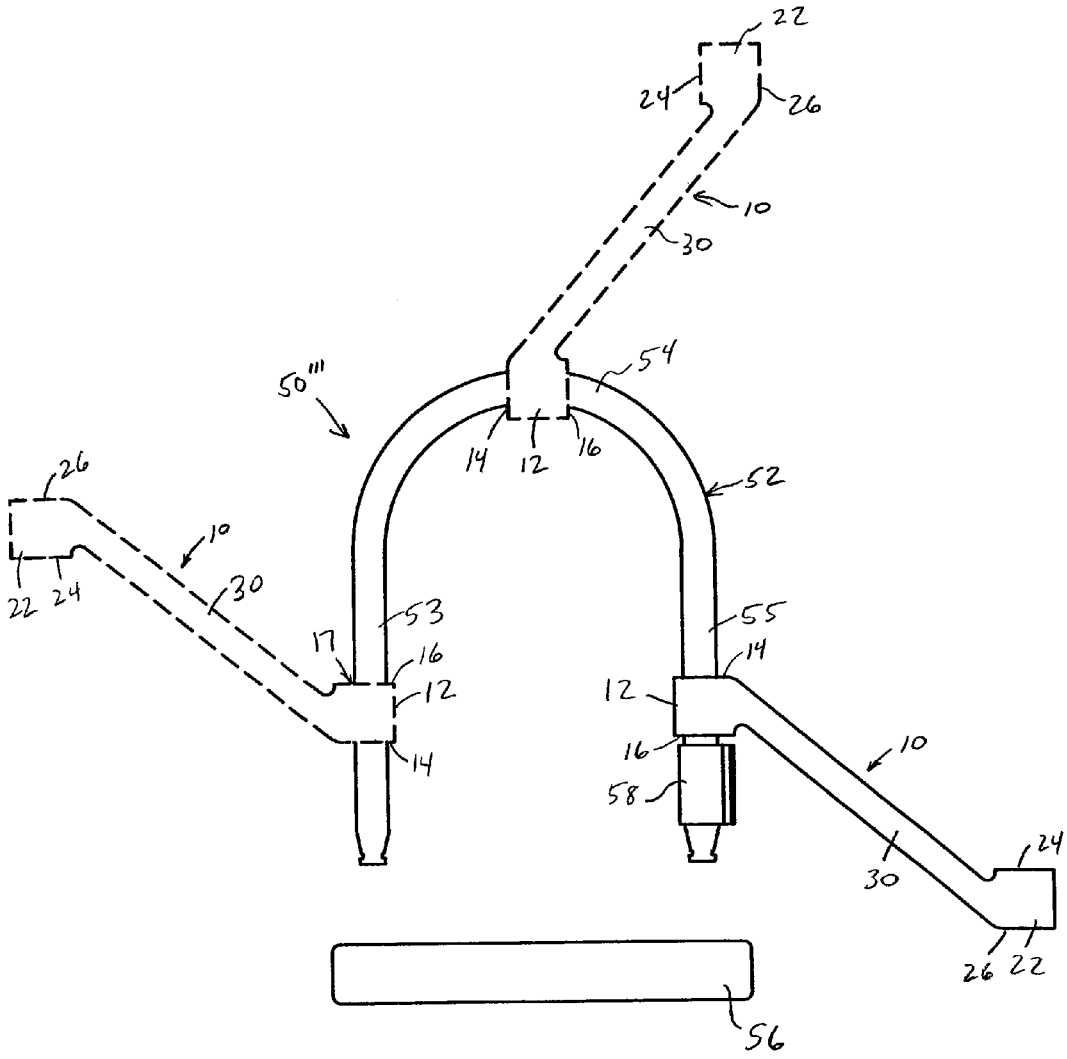
FIG. 6 is a front elevation view illustrating the progressive positioning of the cross brace of FIG. 1 on a third exemplary U-lock.

Referring to FIGS. 4 and 5, the cross brace 10 may be utilized with U-locks 50, 50' having different widths $W_1$, $W_2$ between the legs 53 and 55 of the shackle 52. For example, the U-lock 50 in FIG. 4 may have a shackle 52 with spaced apart legs 53 and 55 joined by U-portion 54 such that the width $W_1$ between the legs 53 and 55 is approximately 6 inches. The cross brace 10 may have a corresponding distance between the central axes CA1 and CA2 such that in the standard orientation of the cross brace 10, i.e. with the central axes CA1, CA2 parallel to the legs 53, 55, the through bores 18 and 28 readily align with the shackle legs 53 and 55.

The U-lock 50' in FIG. 5 has a shackle 52' with spaced apart legs 53' and 55' joined by U-portion 54' such that the width $W_2$ between the legs 53' and 55' is less than the width $W_1$, for example, approximately 5 inches. Since the distance between the central axes CA1, CA2 is greater than the width $W_2$, positioning of the cross brace 10 in the standard orientation will not align the through bores 18 and 28 with the shackle legs 53 and 55. To align the through bores 18, 28 with the legs 53, 55, the cross brace 10 is pivoted counter-clockwise. With the planes P1 and P2 of the top surfaces 14 and 24 offset, a small rotation causes a greater reduction in the crosswise distance between the through bores 18, 28 than if planes P1 and P2 were co-planar. Additionally, because the major axis dimension of each through bore 18, 28 is greater than the diameter of the shackle legs 53, 55, the through bores 18, 28 have sufficient room to allow the legs 53, 55 to pass through at an angle to the central axes CA1, CA2. If the width $W_2$ were greater than the width $W_1$, the cross brace 10 is pivoted in the clockwise direction, thereby increasing the crosswise distance between the through bores 18, 28. This provides great flexibility in the number of U-locks with which a given cross brace 10 may be utilized.

An exemplary use of the cross brace 10 will be described with reference to FIGS. 6-10. The cross brace 10 is utilized with a U-lock 50''' having a bracket connector 58 secured to one of the shackle legs 55. In the illustrated embodiment, the bracket connector 58 is larger than the through bore 18 such that the first engaging member 12 can not be passed up shackle leg 55. Instead, as shown in phantom in FIG. 6, with the crossbar 56 removed, the cross brace 10 is inverted and shackle leg 53 is inserted into the exit 17 of the first engaging member 12. The cross brace 10 is moved up and over the U-portion 54 and down the other shackle leg 55 with the bottom surface 16 of the first engaging member 12 toward the bracket connector 58. The U-lock 50''' is ready for securing of an article. Conveniently, the bracket connector 58 maintains the cross brace 10 on the shackle 52.

Figure 7:
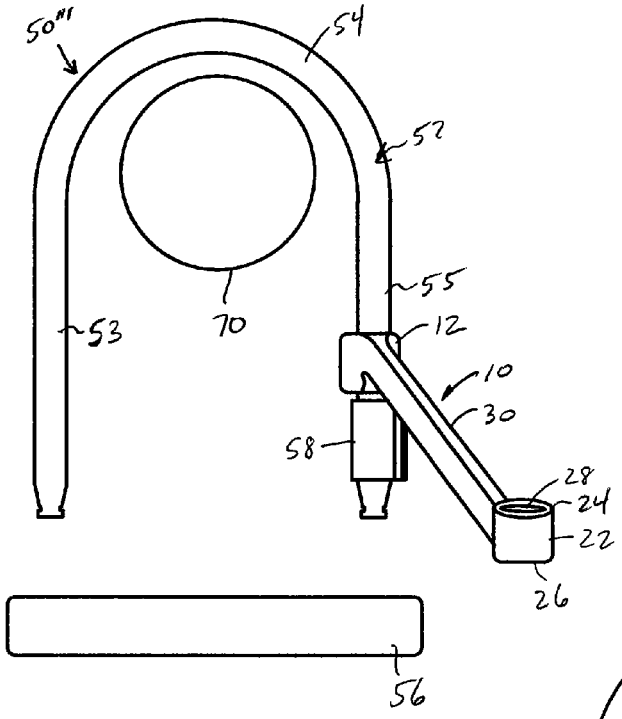

Referring to FIGS. 7 and 8, the shackle 52 is positioned about a fixed object, for example pole 70, or a portion of the article to be secured. The order of positioning of the shackle 52 relative to the article and fixed object will be according to user preferences and is not impacted by the current invention nor is the current invention limited to any particular order. Once the shackle 52 is positioned, the cross brace 10 is rotated to align the through bore 28 with the other leg 53 as shown in FIGS. 7 and 8. As explained above, due to the relative spacing of plane P3 and plane P2, the second engaging member 22 remains clear of the leg 53 during rotation.

Figure 9:
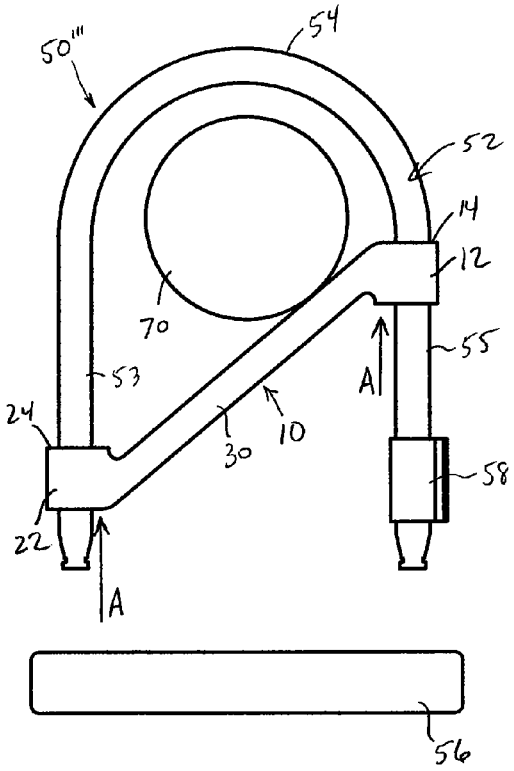
FIG. 9 is a front elevation view similar to FIG. 8 with the cross brace moved to a locking position.

With the through bore 28 aligned with the leg 53, which may require clockwise or counter-clockwise pivoting of the cross brace 10 as discussed above, the cross brace 10 is moved along the shackle 52 in the direction of arrows A in FIG. 9 with the leg 53 received through through bore 28.

Figure 10:
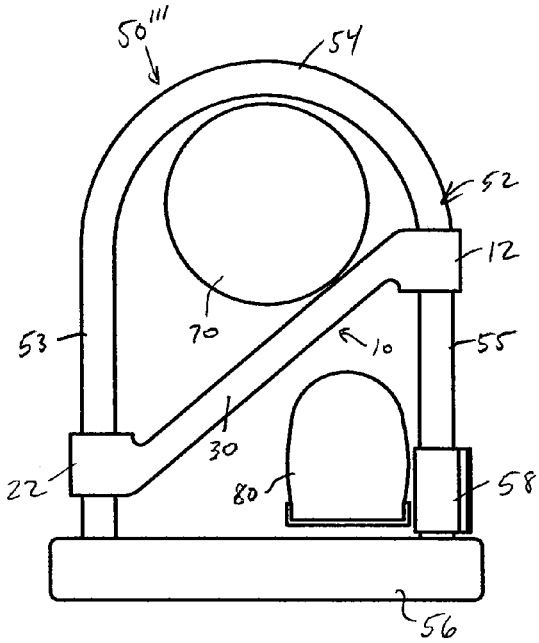
FIG. 10 is a front elevation view similar to FIG. 9 with the U-lock positioned about an exemplary bicycle tire and the crossbar secured to the U-shaped bar.

Referring to FIG. 10, the article, for example a bicycle tire 80, is positioned within the remaining space within the shackle 52 and the crossbar 56 is secured to the shackle 52 in a normal manner. The relative arrangement of the fixed object, article and cross brace 10 may vary and is not limited to that shown in FIG. 10.

As illustrated in FIG. 10, the cross brace 10 extends across the space within the shackle 52, thereby reducing the likelihood that a jack, pry bar or the like may be urged between the legs 53, 55 or between the U-portion 54 and the crossbar 56.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed:

1. A U-lock for locking a bicycle to an object in a locked configuration of the U-lock in order to prevent theft of the bicycle, said U-lock comprising:

a U-shaped shackle that is sized to receive a wheel of the bicycle and the object;

a cross-bar that is removably secured to the U-shaped shackle to lock the bicycle wheel to the object; and a cross brace that is removably positioned on the U-shaped shackle, wherein, in a locked configuration of the U-lock, the bicycle wheel is positioned on one side of the cross brace and the object is positioned on another side of the cross brace, the cross brace comprising:

(a) a first engaging member having a first through bore with a first through bore opening extending in a first plane and a first through bore exit extending in a third plane spaced from the first plane, the first through bore having a first central axis, the first through bore having a smooth continuous surface extending from the first through bore opening to the first through bore exit;

(b) a second engaging member having a second through bore with a second through bore opening extending in a second plane and a second through bore exit, the second through bore having a second central axis, the second through bore having a smooth continuous surface extending from the second through bore opening to the second through bore exit; and (c) a connecting member extending between and connecting the first and second members relative to one another such that the first and second planes are spaced from one another with the third plane between and spaced from the first and second planes and the first and second central axes are spaced from one another in a lateral direction, the connecting member contained within a space between the first and second engaging members in the lateral direction.

2. The U-lock according to claim 1 wherein the U-shaped shackle includes a connector secured to a first leg of the shackle, the connector having an outer diameter greater than a diameter of at least one of the first through bore and the second through bore of the cross brace.

3. The U-lock according to claim 1 wherein the first and second central axes are parallel to one another.

4. The U-lock according to claim 1 wherein the first and second through bores have an elliptical shape.

5. The U-lock according to claim 4 wherein a major axis of each through bore is larger than a diameter of the shackle.

6. The U-lock according to claim 1 wherein the first and second through bores have a circular shape.

7. The U-lock according to claim 6 wherein a diameter of each through bore is larger than a diameter of the shackle.

8. The U-lock according to claim 1 wherein the connecting member has a generally linear configuration.

9. The U-lock according to claim 1 wherein the connecting member has a non-linear configuration.

10. The U-lock according to claim 1 wherein an opening plane extending between the first and second openings and intersecting the first and second central axes is at an acute angle relative to at least one of the first and second central axes.

11. The U-lock according to claim 1 wherein an opening plane extending between the first and second openings and intersecting the first and second central axes is at an acute angle relative to the first and second central axes.

12. The U-lock according to claim 1 wherein the opening plane extends at an angle of approximately 20° to 60° relative to the first and second central axes.

13. The U-lock according to claim 1 wherein the opening plane extends at an angle of approximately 30° to 45° relative to the first and second central axes.

14. The U-lock according to claim 1 wherein the second through bore of the second engaging member has said second through bore exit extending in a fourth plane spaced from the second plane and the connecting member is contained between the first and fourth planes.

* * * * *

UNITED STATES PATENT AND TRADEMARK OFFICE

CERTIFICATE OF CORRECTION

PATENT NO. : 8,181,496 B2
APPLICATION NO. : 12/714925
DATED : May 22, 2012
INVENTOR(S) : Cornelius McDaid It is certified that error appears in the above-identified patent and that said Letters Patent is hereby corrected as shown below:

Col. 6, line 29, delete "1" and insert -- 11 --.

Col. 6, line 32, delete "1" and insert -- 11 --.

Signed and Sealed this
Twentieth Day of November, 2012

David J. Kappos

David J. Kappos
*Director of the United States Patent and Trademark Office*